United States Patent [19]

Rozier

[11] Patent Number: 4,575,893

[45] Date of Patent: Mar. 18, 1986

[54] BROOM WITH FIXING DEVICE FOR HOLDING BUNDLES OF PLASTIC BRANCHES

[76] Inventor: Henry Rozier, Villa Les grives, Le Monteillier, Saint Didier au Mont d'Or, Rhône, France

[21] Appl. No.: 575,441

[22] Filed: Jan. 30, 1984

[30] Foreign Application Priority Data

Feb. 2, 1983 [FR] France ..... 83 01908

[51] Int. Cl.[4] ..... A46B 3/10

[52] U.S. Cl. ..... 15/171; 15/202; 15/159 A

[58] Field of Search ..... 15/194, 171, 68, 175, 15/186, 202, 159 A

[56] References Cited

U.S. PATENT DOCUMENTS

| | | | |
|---|---|---|---|
| 948,617 | 2/1910 | Snevely | 15/175 X |
| 3,881,211 | 5/1975 | Rhodes | 15/159 A |
| 4,031,588 | 6/1977 | Leroy et al. | 15/171 |

FOREIGN PATENT DOCUMENTS

| | | | |
|---|---|---|---|
| 2482853 | 11/1981 | France | 15/194 |

*Primary Examiner*—Peter Feldman

*Attorney, Agent, or Firm*—Weiss & Holloway

[57] ABSTRACT

A broom whose branches made of plastic material are fixed into a main sheath which holds the handle. Each bundle of branches is terminated at the base by a locking tip with a square cross-section. These tips lock into housings arranged inside the main sheath along two coaxial circumferences arranged along planes and staggered along the axis of the broom.

5 Claims, 9 Drawing Figures

BROOM WITH FIXING DEVICE FOR HOLDING BUNDLES OF PLASTIC BRANCHES

This invention relates generally to a broom of the type used by Transportation Department cleaners or cleaning services, to sweep both outside and inside locations.

The broom described herein has a series of plastic "twigs" or a "twig bundle," housed within a main sheath fixed to the lower part of the handle. This invention is intended to provide an improved broom which will enable both the weight and the cost of the broom to be reduced, while improving its performance.

Such a broom consists of a main sheath of plastic material, fixed around a handle and provided with a series of housings around the edge for receiving the fixing stems of the plastic twigs or twig bundles, the whole being covered by a bell-shaped outer sheath which is held in place by screw-type threading, and the housings for the twig are arranged on the main sheath along at least two coaxial circumferences of different diameters, located on planes which are staggered along the geometric axis of the handle to which these two planes are at right angles, each housing also being the female part of an interlocking device of which the male part is on the upper part of the stem of each twig bundle.

According to another feature of this invention, each bundle of twigs ends, at its upper extremity, in a stem which is split lengthwise with a more-or-less square cross-section, of which the split end terminates with at least one projecting locking device.

According to another feature of this invention, each housing on the main sheath has a more-or-less square cross-section which enables it to receive, while being held at an angle, the corresponding male part of the tip of a bundle.

According to another feature of this invention, the male parts of all the bundles locked into the housings of one circumference of the main sheath are angled in the same direction in relation to the diametric plane to which they correspond, while the male parts of the lock-in stems on the other circumference are held at an angle which is at about 90 degrees to those of the first circumference. Due to this arrangement, each bundle of one of the layers on the circumference is at an angle of about 90 degrees in relation to the neighboring bundles on the other layer on the circumference. The effect thus obtained is a sort of enmeshing between the twigs of the two layers around the circumference, which permits an improvement in both the rigidity and flexibility of the broom, while simultaneously reducing the weight of the plastic material used to manufacture each twig bundle.

According to another feature of this invention, each bundle consists of a main stem or branch which is then divided into many branchlets, each of which is then in turn divided into many twigs, and many of the latter have their lower end attached to other twigs which may belong to a different branchlet. Due to this arrangement, the branchlets are, in effect, braced which increases the rigidity of the new branching. However, as the broom is used more frequently and becomes worn, these links between the end of a twig and the neighboring twigs gradually disappear, thus freeing the linkage points and increasing the flexibility of the remaining part of the bundle.

According to another feature of this invention, the staggering of the two circular rows of housings in the direction of their common geometric axis enables the positioning on the finished broom of center bundles whose extremities are longer than those of the outer branches, thus improving the conditions of use of the broom and preserving it as the branches become worn down.

According to another feature of this invention, the main sheath consists of a central cylindrical sleeve of which the extremities each possess interior ridges with sharp edges which will accept and hold firmly, without play, a wooden handle whose exact diameter is permitted considerable variation.

The attached drawing shows an unrestrictive example, which will enable better comprehension of the features of the invention.

DESCRIPTION OF THE PREFERRED EMBODIMENT

Figure 4:
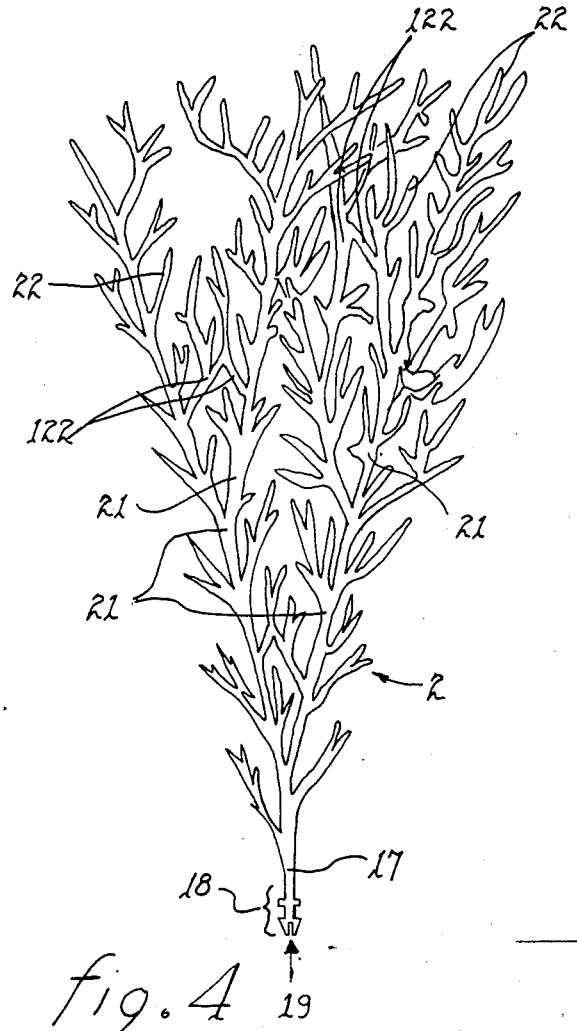
FIG. 4 shows a bundle of twigs in plastic material.
Figure 8:
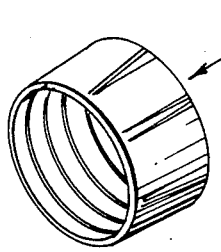
FIG. 8 shows the adjustable ring.
Figure 7:
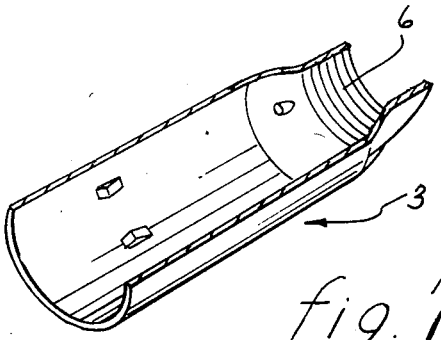
FIG. 7 is an axial section of the bell-shaped outer sheath which covers the whole, after the broom has been assembled.

The broom illustrated in these drawings consists of a bunch 1 consisting of bundles of branches 2 of the type shown on FIG. 4. The top of the bunch 1 is covered by a bell-shaped outer sheath 3, which at its lower end is adapted to fit over the lower part of a handle 4. The upper part of the bunch 1 of branches 2, is surmounted by a sliding ring or collar 5, which can be adjusted to bring it nearer or farther from the outer sheath 3, according to whether one wants to strengthen the whole bunch of branches 1 or make it more flexible for sweeping operations.

The bell-shaped outer sheath 3 possesses on the upper part internal threading 6 which can be screwed onto the corresponding exterior threading 7 with which a cylindrical sleeve 8 of the plastic main sheath 9 is equipped.

Inside each of its two ends, the cylindrical sleeve 8 has a series of ridges 10 with cutting exterior edges which project toward the interior of the cylindrical sleeve 8. The sheath is slit at each end (slits 11).

The central part of the cylindrical sleeve 8 is surrounded by a hub 12, which supports housings which are square in cross-section, reference numbers 13 and 14, respectively.

The housings 14 are divided along a first circumference with a small diameter, arranged immediately around the handle 4, with the openings of the housings 14 located on a horizontal plane 15.

Figure 1:
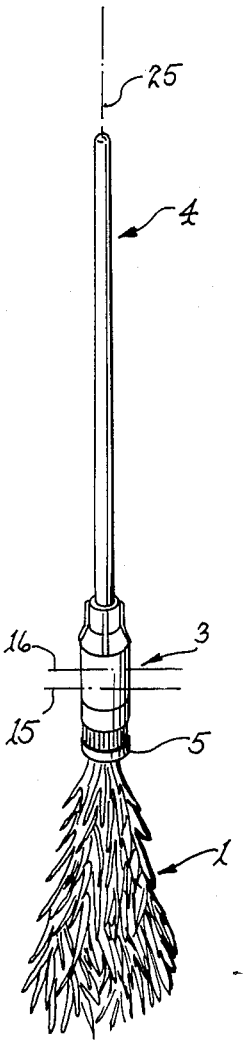
FIG. 1 is an overall view of the broom.
Figure 2:
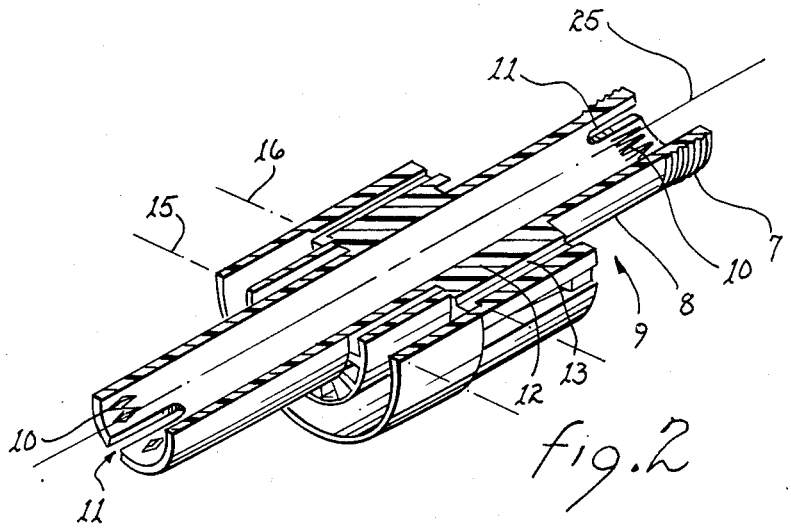
FIG. 2 is an axial section of the main sheath.

However, the housings 13 are arranged along a second circumference, of a larger diameter (arranged coaxially with the first circumference, but around it), with openings onto a horizontal plane 16, staggered in relation to plane 15. Plane 16 is located above plane 15, in relation to the whole broom (see FIG. 1) along the axis 25 of the broom.

Figure 5:
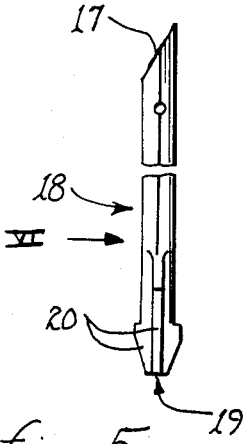
FIG. 5 is a partial front view, showing on a large scale, the detail of the locking device at the end of the bundle.
Figure 6:
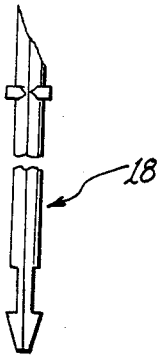
FIG. 6 is a side view following VI (FIG. 5).

Each branch 2 consists of a main stem or end 17, of which the extremity terminates in a tip 18 whose transverse section is square. The tip 18 is slit lengthwise with a diagonal slit 19 (FIGS. 4 to 6) located between two swollen knobs 20, whose purpose is to ensure secure locking into the corresponding housing 13 or 14.

Each bundle 2 is manufactured from a piece of plastic material, and the stem 17 is divided into several branches 21 (four in the illustrated example). Each branch 21 is in turn divided into many twigs 22 of which some (referenced as 122) are distinguished by the fact that their lower ends are bonded to another twig 122, belonging to another branch 21.

Thanks to this arrangement, it can be seen that the two neighboring branches 21 remain linked to each other by the twigs 122, as long as the point at which the two are linked does not become worn. However, as soon as use of the broom affects these linkage points, they will break away from each other, thus removing the link between the two neighboring branches. This ensures that the whole bunch of branches 1 is flexible to use, however worn the broom becomes.

Figure 3:
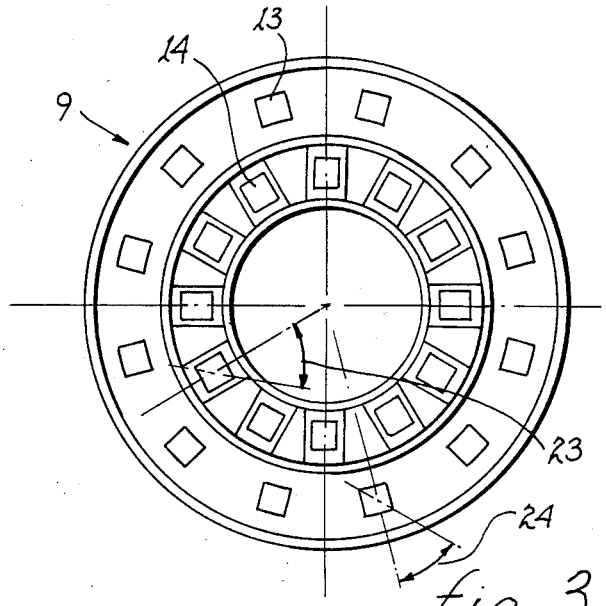
FIG. 3 is a view on a corresponding plane showing the arrangement of the square housings on the two circumferences.

To assemble the broom, each tip 18 of a branch 2 is locked into the corresponding housing 13 or 14. For this operation, it is a good idea to use the following procedure:

In the case of the tips 18 locked into the housings 14 of the small circumference (FIG. 3), the plane of each bundle 2 should be angled along the same diagonal as the square housing 14. To put it another way, each bundle 2 should be given the same angle 23 as defined between the plane of the bundle in question and the diametric plane which corresponds to it on the main sheath 9.

However, to lock the tips 18 of the branches 2 inserted into housings 13 of the outer circumference, the plane of each branch 2 should follow the outer circumference of the square housing 13, i.e., set at an angle 24 opposite to the angles 23 of the central circumference. Thanks to this arrangement, one can see in FIG. 3 that the plane of each bundle 2 of the exterior circumference (housings 13) will be more or less at right angles to the plane of each bundle 2 on the interior circumference (housings 14). The result for the whole bunch of bundles 2 will be a sort of meshing which allows the whole bundle 1 of the broom both flexibility and sensitivity, although this has permitted a reduction in the weight of the plastic material used for each bundle 2.

Figure 9:
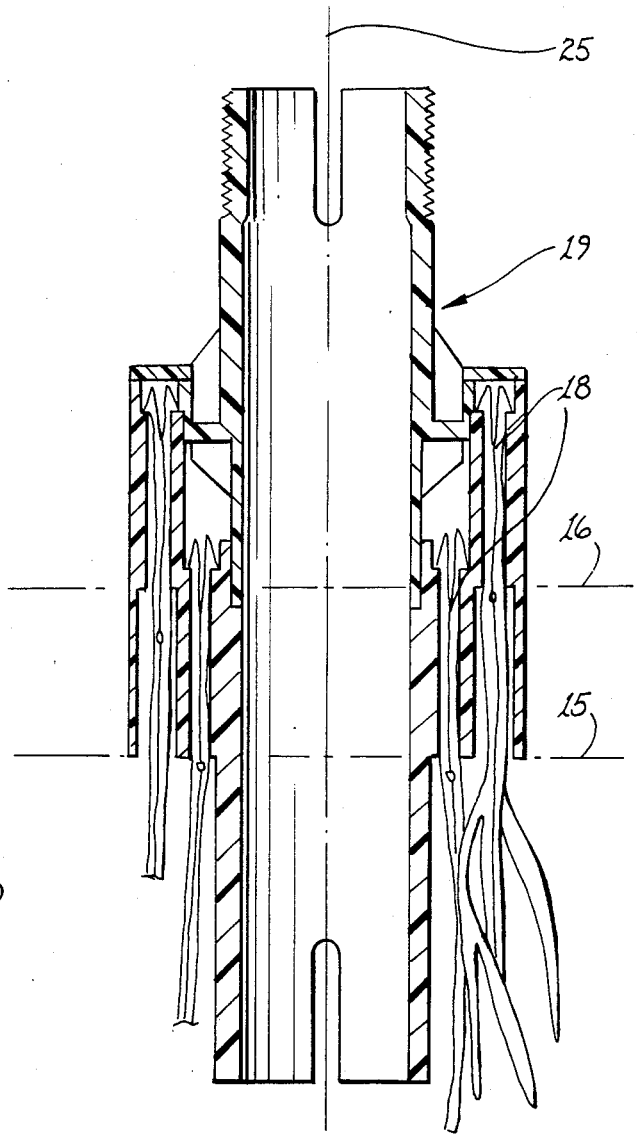
FIG. 9 is an axial section corresponding to FIG. 2, after the bundles have been inserted.

After all the bundles have been positioned by locking them into their male tips 18, the whole of the main sheath 9 looks like the illustration FIG. 9. All that remains, therefore, is to force the handle 4 into the cylindrical sleeve 8, then to screw down the threading 6 on the outer sheath 3 onto the corresponding thread 7 of the main sheath 9, to obtain the broom illustrated in FIG. 1. As indicated above, the presence of the sharp-edged ridges 10 allows the wood of the handle 4 to be inserted more or less deeply, in such a way as to hold it firmly in place without play, after tightening the outer sheath 3, even if the diameter of the wood varies from one handle 4 to another.

While the invention has been particularly shown and described in reference to preferred embodiments thereof, it will be understood by those skilled in the art that changes in form and details may be made therein without departing from the spirit and scope of the invention.

I claim:

1. A broom comprising a main sheath made of plastic material locked around a handle and equipped with a series of peripheral housings used to hold stems of twigs and branches of bundles made of plastic, said main sheath being covered by a threaded, bell-shaped outer sheath, said housings for the ends of said bundles being arranged around said main sheath following at least two coaxial circumferences of different diameters located on planes and staggered along the geometric axis of said handle to which said two planes are at right angles, each housing having a female part of a locking device, each bundle having a male part of said locking device on the upper extremity of each bundle, each bundle having a tip at a top end which is part of said male part and is split lengthwise, said tip having a substantially square cross-section, said split end being surmounted by at least one swollen knob, each housing on said main sheath having a cross-section which is substantially square in order to enable said housings to receive said male parts of said bundles and to allow each of said bundles located at one of said circumferences to be oriented at approximately the same angle with respect to a corresponding one of each of said bundles located at another of said circumferences.

2. A broom comprising a main sheath made of plastic material locked around a handle and equipped with a series of peripheral housings used to hold stems of twigs and branches of bundles made of plastic, said main sheath being covered by a threaded, bell-shaped outer sheath, said housings for the ends of said bundles being arranged around said main sheath following at least two coaxial circumferences of different diameters located on planes and staggered along the geometric axis of said handle to which said two planes are at right angles, each housing having a female part of a locking device, each bundle having a male part of said locking device on the upper extremity of each bundle, each bundle having a tip at a top end which is part of said male part and is split lengthwise, said tip having a substantially square cross-section, said split end being surmounted by at least one swollen knob, each housing on said main sheath having a cross-section which is substantially square which enables each housing to receive, while being held at an angle, one of said male parts of said bundle, said male tips of said bundles being locked into said housings at a first circumference of said main sheath are angled in the same direction, with an angle in relation to a corresponding diametric plane, so that said male tips of said bundles locked into said housings at the other circumference of said main sheath are at an angle of substantially 90 degrees to said male tips locked into said housings at said first circumference in order that each bundle at said first circumference is orientatial at a substantially 90 degree angle in relation to a neighboring bundle at the other circumference.

3. A broom according to claim 2 wherein each bundle comprises a main stem which is then divided into several branches each of which in turn is divided into many twigs, many of said twigs having their lower end attached to other twigs which can belong to a different branch so that there is a bracing effect which increases the rigidity of the new branching and which gradually disappears as the broom is used and becomes worn.

4. A broom according to claim 3 wherein the planes of said housings located around said circumferences are staggered along a common geometric axis, which on the finished broom enables attachment of central bundles at an inner circumference with stems that are longer than stems of bundles attached at an outer circumference, thus improving the usefulness of said broom and preserving said broom as said branches become worn.

5. A broom according to claim 4 wherein said main sheath has a central cylindrical sleeve whose extremities contain sharp-edged interior ridges which enable a wooden handle to be firmly grasped without play, the exact diameter of which is permitted considerable variation.

* * * * *